United States Patent [19]

Cohodar

[11] Patent Number: 4,953,327

[45] Date of Patent: Sep. 4, 1990

[54] MINI-OFFICE FACILITY

[76] Inventor: Alija Cohodar, 495 NE. 83rd St., Miami, Fla. 33138

[21] Appl. No.: 427,499

[22] Filed: Oct. 27, 1989

[51] Int. Cl.[5] ..... A47B 81/00

[52] U.S. Cl. ..... 52/36; 52/33; 232/24

[58] Field of Search ..... 52/33, 36, 238.1; 232/24, 25, 26

[56] References Cited

U.S. PATENT DOCUMENTS

| | | | |
|---|---|---|---|
| 702,479 | 6/1902 | Reasoner | 232/25 |
| 1,345,481 | 7/1920 | Davis | 52/33 |
| 1,348,024 | 7/1920 | McCarthy | 52/33 |
| 2,581,140 | 1/1952 | Puttre | 52/33 |

*Primary Examiner*—Carl D. Friedman
*Assistant Examiner*—Linda Jean Hoffert

[57] ABSTRACT

A facility specifically structured to define a plurality of "mini-offices" each of which includes a compartmented area or space accessible from a common access area to selected, authorized individuals or proprietors of individual ones of such mini-offices and further wherein each of the compartmented areas has a secondary, at least partial access, for restricted "official" personnel such as a mail carrier for the delivery of mail thereto.

14 Claims, 2 Drawing Sheets

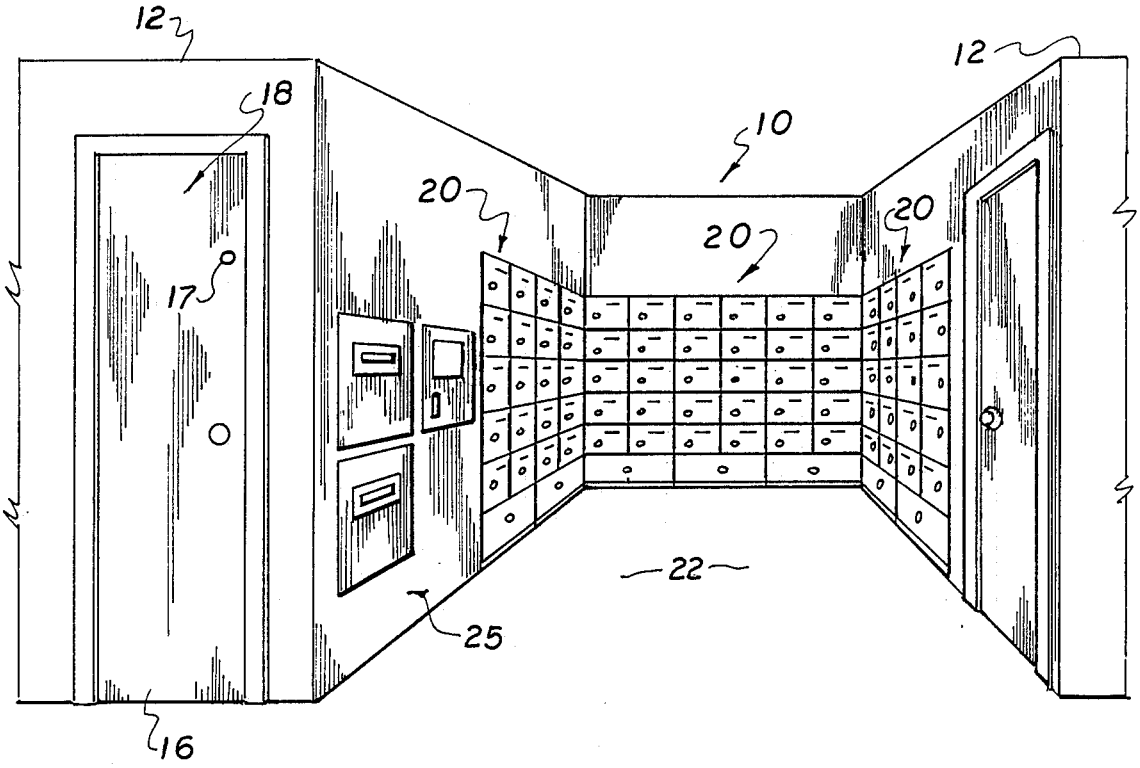
FIG. 1
FIG. 2
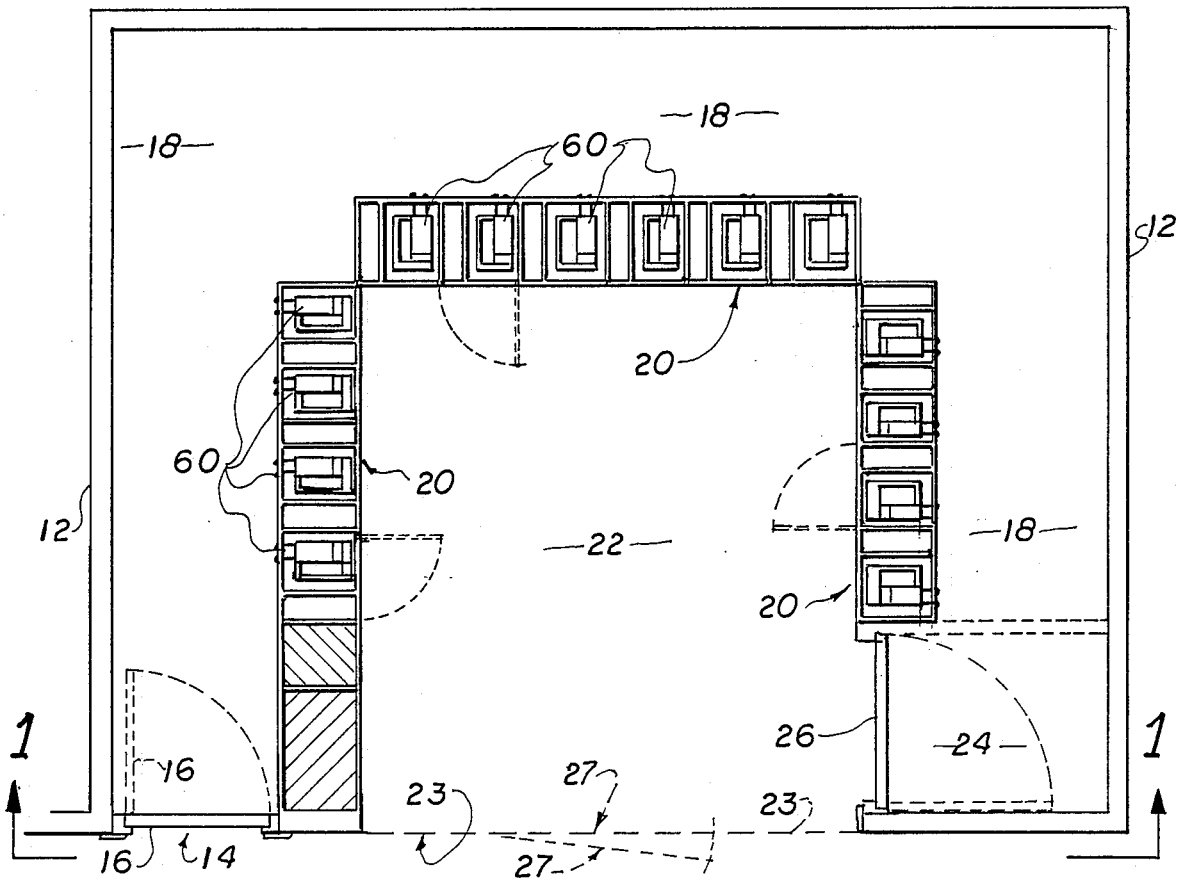

MINI-OFFICE FACILITY

BACKGROUND OF THE INVENTION

1. Field of the Invention

A mini-office facility defined by a plurality of compartmented spaces each being independently accessible by authorized personnel for purposes of receiving mail service and utilizing electrical and/or telephone utilities and wherein the plurality of mini-offices are all collectively accessible by "official" personnel on a restricted basis such as for purposes of mail delivery.

2. Description of the Prior Art

A typical commercial or business office comprises one or more rooms with appropriate desks, chairs and like required furniture as well as the use of electrical utilities for the purpose of powering lights, office equipment, etc. Naturally, such a conventional office facility has the advantage of being able to receive customers or clients, conduct conferences, provide for mail service and of course, be connected to conventional telephone utilities. In most business or commercial situations, such a conventional office is required and, accordingly, the expense maintaining such an office is necessary and is a considered part of the cost of doing business.

However, in many business situations it is only necessary for a person to maintain a transient or minimal "presence" within a city, town, state, or other geographical location. In such situations, the maintenance and expense of a conventional office is burdensome even to the extent of sometimes preventing someone from doing business at a given location. Leasing agencies, building management businesses and the like have attempted to overcome the above set forth problem by leasing, perhaps on a short-term basis, minimal office locations to businesses or individuals who intend to use such temporary quarters only for purposes of receiving mail service and possibly making or receiving telephone calls. Actual visitation by customers or clients to such offices is not required. In the latter situations, the money spent by a business or individual on rent, monthly electrical bills, furniture purchase or rental, etc. is still only necessary because such temporary office quarters are the only facilities available. Accordingly, such "unnecessary" expenses are still overburdensome and may eliminate the possibility of someone doing business in a given locale.

The opposite end of the spectrum exists wherein a business or individual may easily rent a post office box for the receipt of mail. However, post office boxes of course are absent any additional utilities such as telephone connections, electrical outlets and therefore are extremely limited in their versatility to the extent of offering to the small business man an inexpensive yet effective locale and address from which business can be conducted.

Accordingly, there is obviously a need in this area for a facility which comprises a plurality of "mini-offices" each having a primary access to a compartmented interior defining the offices such that only authorized personnel has access thereto. Each of such mini-offices is specifically structured and disposed to facilitate mail service thereto by official personnel and to provide telephone and electrical utilities or outlets such that telephone messages can be made, received and stored as desired.

Summary of the Invention

The present invention is directed to what may be referred to as a "mini-office" facility comprising a plurality of compartmented spaces each of which is specifically structured for the provision of telephone utilities and electrical utilities and further structured to allow mail delivery thereto. Therefore, all the basic requirements or essential services may be conducted by utilizing an extremely small compartmented space. This space may be accessed only by authorized personnel leasing such spaces and by a lessor or proprietor. A secondary access opening of each of the spaces is available on a restricted basis only to "official" personnel such as mail carriers or post office employees.

More specifically, a plurality of compartments are disposed in an acceptable efficient array which may be defined as a side-by-side and/or stacked arrangement. Each compartment defines one "mini-office" and includes a hollow interior divided, preferably by a separating partition, into a primary portion and a secondary portion. Both of these primary and secondary portions communicate directly with a front access opening so that through such front access opening a user of the compartment or mini-office may have clear access to the contents of both the primary and secondary portions of the compartment. However, in order to prevent access by any unauthorized person, a closure means is provided in the form of a front door or closure member including a lock mechanism. The front door is pivotally secured in covering relation to the front access opening and selectively positionable upon operation of the locking mechanism into and out of a closed position relative to both primary and secondary portions of a given compartment.

Further, each compartment comprises a rear access opening which is preferably structured for communication only with the secondary portion of the hollow interior of the compartment and specifically disposed in non-communicating relation with the primary portion of the compartment. Such rear access opening is provided for the delivery of mail by an official or employee of the postal service. In addition, the rear part of the housing includes an auxiliary chamber serving essentially as a utility chamber for the installation and maintenance of utility switching boxes and the like. Accordingly, all of the plurality of compartments defining the plurality of mini-offices have their respective rear access opening disposed in collective communication with a restricted but common access area. The access area communicating with the rear access opening of each of the compartments is "restricted" to the extent that entrance into this restricted access area may be accomplished only by "official" personnel such as utility installers or repair people or postal employees authorized to deliver mail. Naturally, the general public or those leasing the various mini-offices would not have access to this restricted access area.

An important feature of the present invention is the provision of both electrical and telephone utilities to each of the compartments in a convenient and readily accessible manner. By virtue of this structure, any of the "occupants" of the mini-offices may maintain a telephone, telephone answering machine, FAX machines, etc. in the primary portion of the respective compartments defining one's mini-office. Again, the interior of each primary portion and the telephone equipment maintained therein would not be accessible from the rear of the housing or the auxiliary, utility chamber mounted on the rear of the housing. Access to the telephone equipment maintained in the primary portion is prevent due to the existence of a rear, blocking barrier or partition between the auxiliary or utility compartment, referred to above, and the primary portion. This blocking partition is mounted on or adjacent to the rear most end of the primary portion. Again, the existence of a separating partition extending from the front end to the rear end of each of the compartments serves to separate and effectively isolate the primary portion and the secondary portion of such a compartment.

It should be readily apparent therefore that each of the compartments defining individual mini-offices is locked by the aforementioned front and rear closure means and accordingly only authorized personnel are allowed to have access to the interior thereof. Further, the interior is divided into designated portions for the maintenance of telephone equipment or any other applicable equipment therein such that an authorized user of one of the mini-offices may enter a common access area, unlock the front door of his compartment, pick-up mail, receive messages from his telephone equipment located in the primary portion of his compartment and make telephone calls and otherwise use whatever equipment is maintained in the primary portion.

Brief Description of the Drawings

FIG. 1 is a perspective view of an array of mini-offices all being accessible from a common access area.

FIG. 2 is a transverse sectional view of the embodiment of FIG. 1 showing the interior of certain ones of the compartments defining the mini-offices.

Description of the Preferred Embodiment

Figure 3:
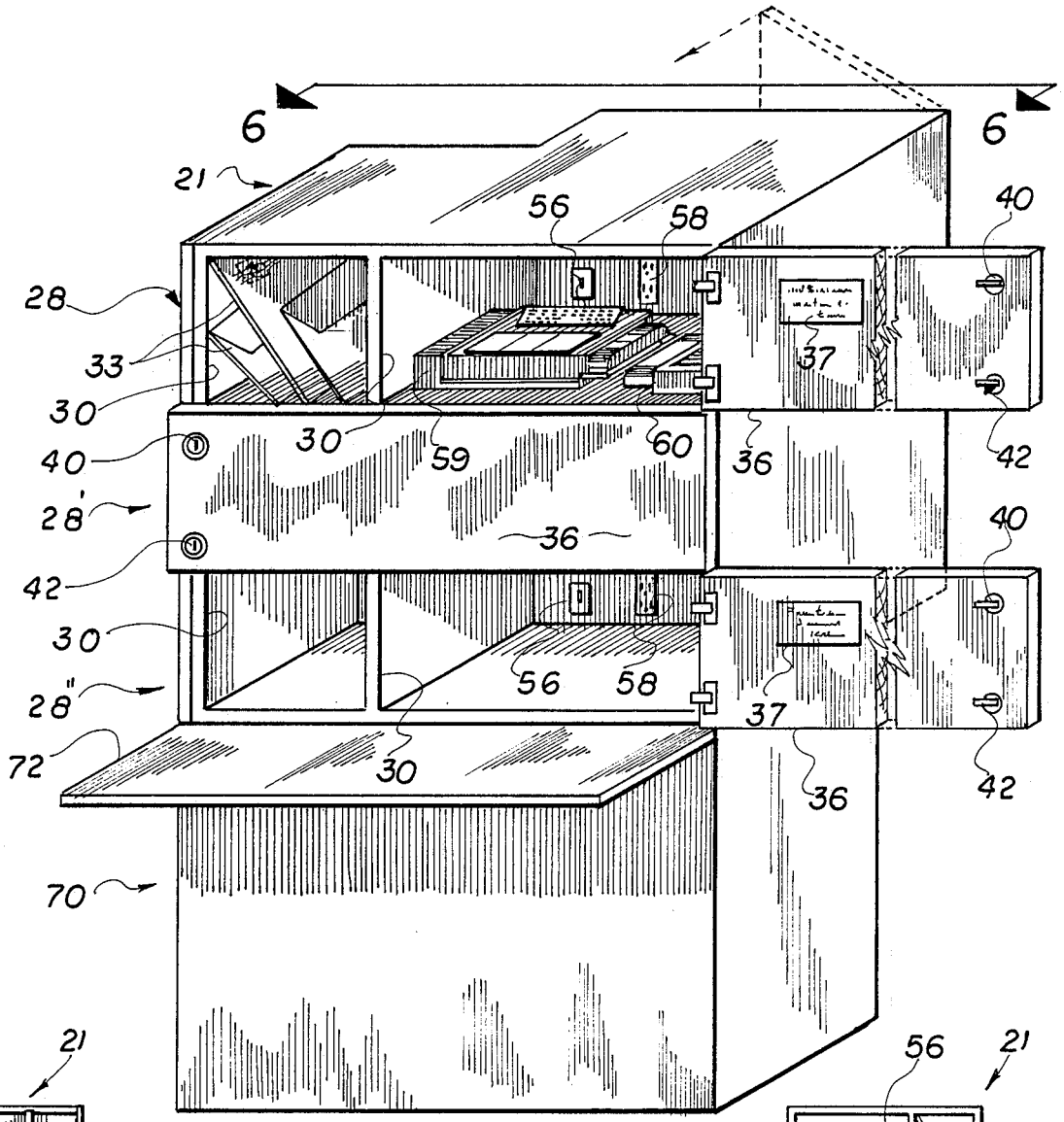
FIG. 3 is a perspective view of the housing including a plurality of compartments of the present invention thereon.
Figure 4:
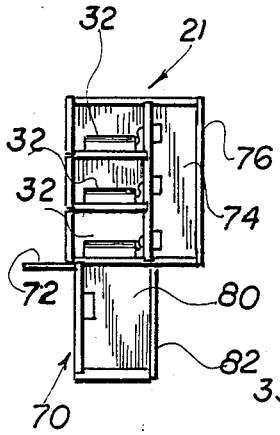
FIG. 4 is a side, sectional view showing interior features of the structure of FIG. 3.

As shown in FIGS. 1 through 6, the present invention is directed to a facility structured to provide what may be referred to as "mini-offices" and being generally indicated as 10. The facility 10 may include an inner enclosure 12 having at least one entrance 14 with a door 16 and applicable lock means (not shown) regulating passage therethrough. The enclosure 12 primarily houses what may be referred to as a restricted access area 18 disposed substantially rearwardly to a bank of a plurality of compartments collectively and generally indicated as 20. The frontal portions of the collective compartments 20 are disposed in communicating relation with a common access area 22 located in a more readily accessible locale relative to the enclosure 12. The entrance generally indicated as 23 may be open as shown in FIG. 1 or alternately, may include some type of door structure represented in phantom lines as 25 and having an entrance means 27 providing access thereto. In actual practice, the entrance 27 may be locked thereby allowing only proprietors or authorized persons to enter into the common access area 22 to provide access and use of designated ones of a plurality of compartments 20. Alternately, absent any type of door or barrier 25 across entrance 23, the common access area 22 may be open to the public. It is assumed that individual access to the compartments will be restricted by the closure means associated with each of the respected compartments to be described in greater detail hereinafter. Other structures associated with the facility 10 and specifically the enclosure portion 12 may include a storage or office area 24 which may or may not have restricted access thereto by a door 26 with an appropriate lock or like facility thereon.

As shown, each of the individual mini-offices is defined by one of a plurality of compartments where in the compartments (shown in detail in FIGS. 3 and 6) are individually, and generally represented, as 28. As shown, each compartment 28 has a front access opening 30 and a hollow interior separated into a primary compartment portion 32 and a secondary compartment portion 34. Both the primary portion 32 and the secondary portion 34 communicate with the front access opening 30. The front access opening 30 may be covered by a closure means generally represented as 36 and including a front door or cover 38 preferably having at least two locks as at 40 and 42 secured thereto. The locks 40 and 42 can be key operated to prevent unauthorized access to the interior of the compartment 28 and any contents thereof. Therefore, it should be readily apparent from a review of FIG. 3 that one who is authorized or who leases the "mini-office" merely undoes the latch structure 40, opens the door or cover 38, and thereby has access both to the primary portion of the compartment 32 and the secondary portion 34 thereof. The secondary lock 42 is utilized by the proprietor or owner of the facility 10 and may function to prevent access to a given compartment if a lease payment thereon is not made.

Figure 5:
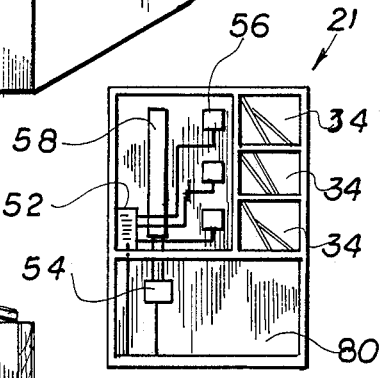
FIG. 5 is a rear view showing interior features of the structure of FIG. 3.
Figure 6:
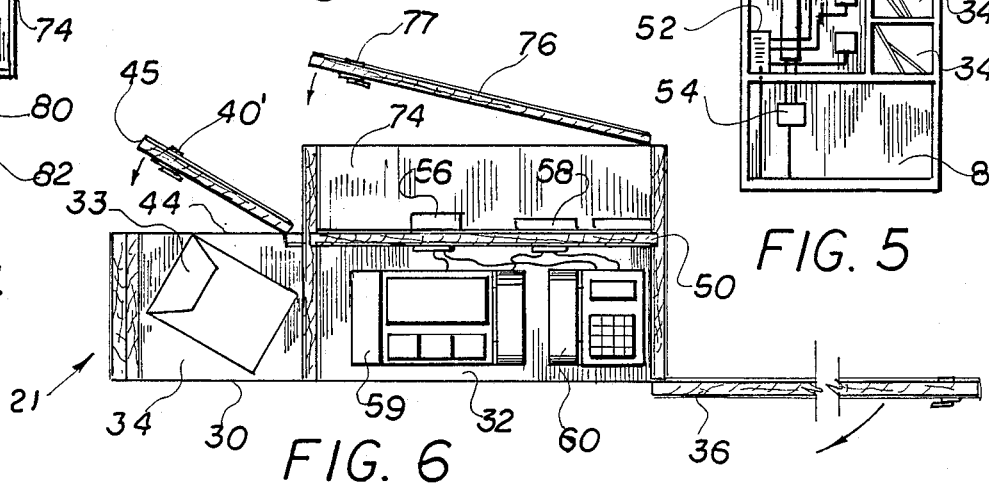
FIG. 6 is a transverse sectional view along line 6—6 of FIG. 3.

With reference to FIGS. 5 and 6, each of the compartments has its rear portion communicating directly with the restricted access area 18. Accordingly, each of the compartments, three of which are represented as 28, 28′ and 28″ in FIGS. 3 through 6, includes a rear access opening 44 communicating only with the secondary compartment portion 34. Therefore, the opening 44 allows mail delivery to each of the plurality of compartments 28, 28′, 28″ etc. through the rear access opening 44 such that such mail is delivered or left only in the secondary compartment portion 34 of each main compartment 28. The rear access opening 44 does not provide or allow communication with the primary compartment portion 32 and therefore does not allow access or use by postal employees or any other authorized personnel to the contents of the primary portion 32. To prevent such access to the primary portion, an inner partition 48 is provided and extends between the primary and secondary compartment portions 32 and 34 as shown both in FIGS. 4 and 5. To the contrary, each of the primary portions of the compartments 32 has a permanently affixed rear partition or barrier 50 sealing off the primary compartment portion 32 from the restricted access area 18 (see FIG. 2) and from a utility compartment.

As shown in FIGS. 3 through 6, details of the present invention include the existence of a housing 21 preferably having a plurality of such compartments 28, 28′, and 28″ arranged in a vertically stacked array on top of one another. Further, the housing may include an attached or detachable supporting portion as at 70 serving to mount and support the plurality of compartments above a supporting surface such as the floor or like. Frequently, the location of such compartments a minimum distance above the floor or supporting surface is required. In addition, an operable counter or shelf as at 72 may be considered part of the support means 70 and extend outwardly therefrom to provide working space for those having access to their individual compartments. With regard to FIG. 1, the housing 21 may be arranged in a somewhat side by side relationship giving an overall appearance as shown in FIGS. 1 and 2. However, such is not specifically necessary in order to fall within the scope of the present invention.

As set forth above, the rear of the housing has a rear access opening 44 for providing access to the secondary portion 34 and used primarily for the delivery of mail by authorized personnel. Rear closure means 45 are provided and hingedly connected to the housing and, in a preferred embodiment, the rear closure means 45 is in the form of an elongated door sufficiently dimensioned to be positioned in covering or non-covering relation to each of the secondary portions 34 of the various compartments 28, 28', and 28" concurrently. Therefore, a postal employee may open a lock as at 40' by an authorized and coded postal key and move the rear closure means or door 45 to its open position. This will uncover each of the plurality of compartments disposed in a vertically stacked array as part of the housing 21.

Another feature includes an auxiliary chamber 74 serving as a utility chamber for the maintenance of a plurality of utility switching and/or installation assemblies as at 56 and 58. An auxiliary closure means as at 76 which also may be locked as at 77 is capable of being disposed so as to cover or non-cover the interior of the chamber 74 and allow access for insulation or repair of the utility switching assembly means 56, 58, etc. The utility or auxiliary chamber 74 is located immediately behind each of the primary portions of the plurality of compartments 28, 28', and 28" and separated from access thereto by the existence of the aforementioned barrier or blocking partitions 50 associated with each of the primary portions 32.

Yet another feature of the present invention is the existence of a storage means as at 80 formed within the interior of the support means 70 and also having an access door and/or cover member 82 which may be selectively opened to provide access or storage by the proprietor and/or storage area which can additionally be leased out for the containment of supplies or the like.

Yet other features of the present invention include exposed inner surfaces of the front access doors 36 on which operating or occupational licenses 37 may be mounted for display if in fact such are necessary.

An important feature of the present invention is the provision of both conventional electrical and telephone utility hardware 52 and 54 and specific outlets to each of the plurality of compartments 28. Individual outlets 56 and 58 provide telephone access and electrical access respectively as shown in FIGS. 3 through 6. Therefore, since both electricity and telephone outlets are provided, a telephone answering machine 59 as well as an operating telephone 60 may be maintained within the primary portion 32. Access to the instruments 59 and 60 are only provided through the front access opening 30 since the rear access opening 44 will not communicate with the primary portion of the compartment 32 or the contents thereof 59 and/or 60.

The operation of each of the individual mini-offices or compartments 28 may be such as to allow an outside person using conventional telephone facilities to call a person's "mini-office" and reach an answering machine 59. The authorized person having access to a given compartment may, on rare occasion, be present during an incoming telephone call and of course may answer it using the telephone instrument 60 or any conventional phone connected to the outlet 56. Alternately and most probably, a message will be stored by the instrument 59 and an authorized person will visit the specific mini-office 28, open the closure means 36 and have direct access to the instrument 59. Alternately, an authorized person may, through proper coding techniques of which the instrument 60 is capable, call the answering machine, implement the proper code through a touch-tone telephone and receive the message.

Other features associated with the facility 10 and as generally represented in FIG. 1 may include various vending machines generally indicated as 75 which may include stamp machines, cash or change providing machines, beverage or food vending machines, etc.

Now that the invention has been described,

What is claimed is:

1. A storage and receiving structure designed to define a mini-office facility, said structure comprising:

(a) a housing comprising a hollow interior defining at least one compartment defining a mini-office and including a front access opening, (b) a separating partition extending from a front end of each of said compartments within said housing adjacent said front access opening to a rear end of said compartment, (c) said separating partition disposed inwardly from side walls of said compartment and dimensioned and disposed to define, with said side walls, a primary portion and a secondary portion, (d) said primary and secondary portions isolated from one another and both including a front end communicating with and accessible through said front access opening, (e) a rear access opening formed in said housing in communicating, accessible relation with said secondary portion of said compartment and isolated from said primary portion, (f) a front closure means disposed in covering and non-covering relation to said front access opening and said primary and secondary portions and a rear closure means disposed in covering and non-covering relation to said rear access opening and said secondary portion, and (g) telephone and electrical utility outlet means mounted on an interior of said primary portion for providing telephone and electrical service to said primary portion, (h) whereby a telephone and telephone answering-/recording machine may be operatively maintained within said primary portion.

2. A structure as in claim 1 wherein said primary portion includes a blocking partition secured to a rear end of said primary portion in covering, closing relation thereto and in abutting disposition to and in isolating disposition to an exterior rear of said housing.

3. A structure as in claim 2 wherein said housing comprises an auxiliary chamber formed on a rear portion thereof substantially behind said blocking partition and segregated from said primary partition of said compartment; utility supply switching facilities mounted within said auxiliary chamber.

4. A structure as in claim 3 further comprising an auxiliary closure means spaced from said rear, access opening and rear closure means and disposed and structured for covering and uncovering said auxiliary chamber.

5. A structure as in claim 1 wherein said housing includes a plurality of compartments each defining a separate, isolated mini-office, said plurality of compartments disposed in a vertically stacked array.

6. A structure as in claim 5 further comprising a support member disposed on a supporting surface and including an upper end adapted to engage and support said plurality of components thereon in spaced relation to the supporting surface.

7. A structure as in claim 5 wherein each of said compartments includes a separate spaced apart front closure means disposable in covering and non-covering relation to said front access opening thereof.

8. A structure as in claim 5 wherein each of said plurality of compartments on said housing comprise a common rear closure means movably mounted on a rear of said housing and positionable in covering and non-covering relation to all of said rear access openings of said plurality of compartments.

9. A structure as in claim 8 wherein said housing comprises an auxiliary chamber formed on a rear portion thereof substantially behind said blocking partition and segregated from each of said primary portions of all of said compartments; utility supply switching facilities mounted within said auxiliary chambers and structured to service each of said plurality of compartments.

10. A structure as in claim 9 further comprising an auxiliary closure means spaced from said rear access opening and rear closure means and disposed and structured for covering and uncovering said auxiliary chamber.

11. A structure as in claim 6 further comprising a storage chamber formed within said support member beneath said plurality of compartments.

12. A structure as in claim 1 wherein both said front closure means and said rear closure means comprise lock means secured thereto and each coated to be operable by separate locks for independently locking thereof.

13. A structure as in claim 1 wherein said primary portion of each of said compartments is dimensioned and configured to receive and maintain a telephone and answering/recording machine therein.

14. A structure as in claim 13 wherein said primary portion of each of one said compartments is larger than said secondary portion and said secondary portion is at least sufficient postal service dimensions to receive mail therein.

* * * * *